US006708908B2

(12) United States Patent
Heldt et al.

(10) Patent No.: US 6,708,908 B2
(45) Date of Patent: Mar. 23, 2004

(54) PAINT ATOMIZER BELL WITH IONIZATION RING

(75) Inventors: Robert F. Heldt, Oxford, MI (US); Thomas Loch, Farmington Hills, MI (US); Jacob J. Braslaw, Farmington Hills, MI (US); Michael P. Gibbons, Westland, MI (US); Charles K. Altermatt, Canton, MI (US)

(73) Assignee: Behr Systems, Inc., Auburn Hills, MI (US)

( * ) Notice: Subject to any disclaimer, the term of this patent is extended or adjusted under 35 U.S.C. 154(b) by 0 days.

(21) Appl. No.: 09/896,557

(22) Filed: Jun. 29, 2001

(65) Prior Publication Data

US 2003/0001031 A1 Jan. 2, 2003

(51) Int. Cl.[7] ..... B05B 5/00
(52) U.S. Cl. ..... 239/700; 239/690.1; 239/690
(58) Field of Search ..... 239/690, 690.1, 239/697, 698, 699, 700

(56) References Cited

U.S. PATENT DOCUMENTS 3,408,985 A * 11/1968 Sedlacsik, Jr. ..... 118/629
4,381,533 A * 4/1983 Coffee ..... 361/228
4,659,012 A * 4/1987 Coffee ..... 239/3
4,771,949 A 9/1988 Behr et al. ..... 239/699
4,851,253 A 7/1989 Schneider et al. ..... 427/8
4,852,810 A 8/1989 Behr et al. ..... 239/703
4,872,616 A 10/1989 Behr et al. ..... 239/703
4,962,885 A * 10/1990 Coffee ..... 239/3
5,052,617 A * 10/1991 Colclough et al. ..... 239/4
5,085,373 A * 2/1992 Behr et al. ..... 239/690
5,154,358 A * 10/1992 Hartle ..... 239/697
5,163,625 A * 11/1992 Takayama et al. ..... 239/703
5,738,727 A 4/1998 Cebola et al. ..... 118/631

* cited by examiner

*Primary Examiner*—Christopher Kim
(74) *Attorney, Agent, or Firm*—Howard & Howard

(57) ABSTRACT

An ionizing device generates ionizing lines to shape solvent borne coating material being dispersed from an electrostatic rotary atomizer. A band having a clamping element affixes the device to the electrostatic rotary atomizer. A halo is affixed to the band by at least one support arm. The halo includes a plurality of generally conical members spaced therearound, each generating ionic lines to shape the atomized coating material being dispersed from the rotary atomizer. A shroud is positioned around each of the generally conical members to shape the ionizing lines being generated to form an ionic field to improve the transfer efficiency of the electrostatic rotary atomizer.

14 Claims, 3 Drawing Sheets

Fig-3
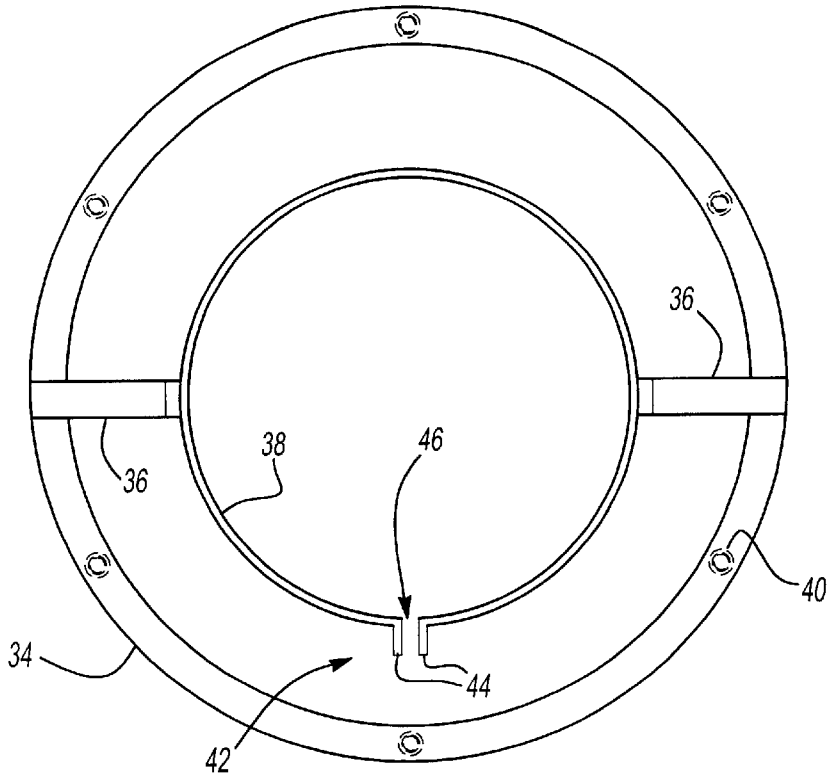
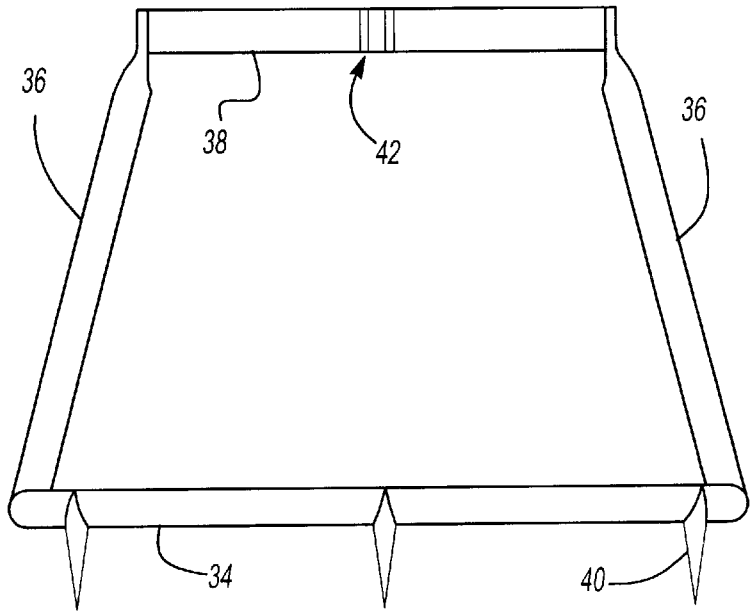
Fig-4

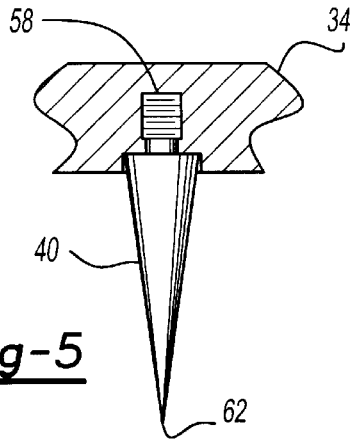
Fig-5
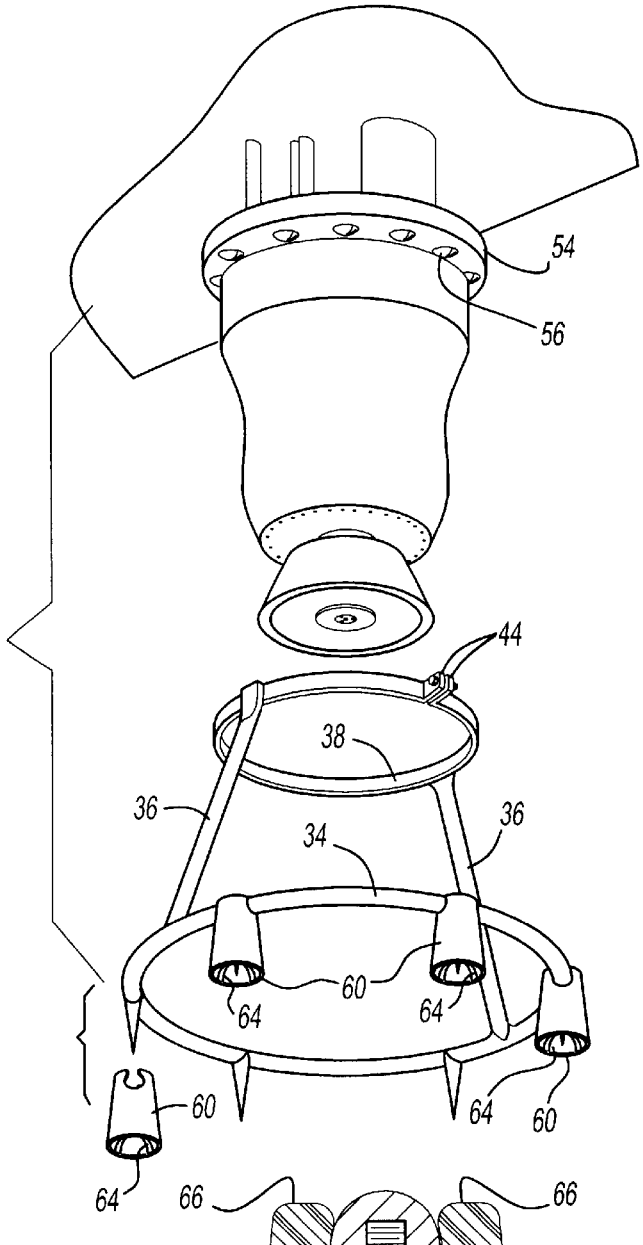
Fig-6
Fig-7
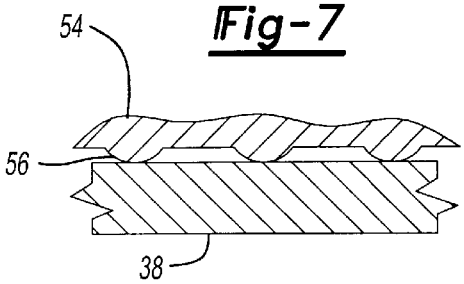
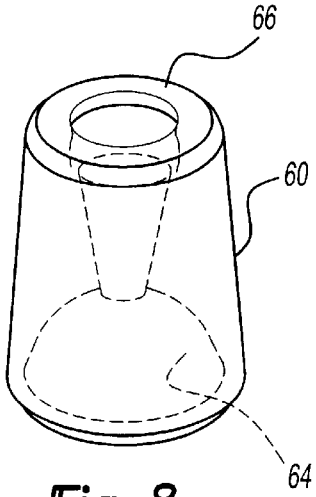
Fig-8
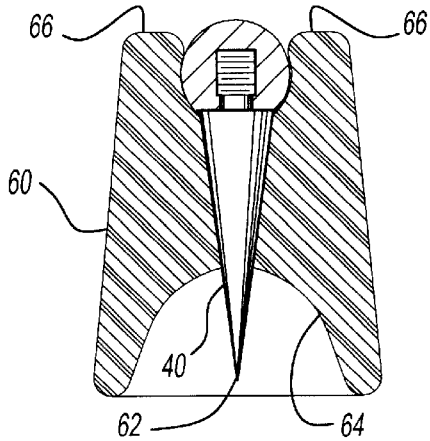
Fig-9

PAINT ATOMIZER BELL WITH IONIZATION RING

BACKGROUND OF THE INVENTION

The subject invention relates generally to an improved spray gun utilizing coating material with a wide range of conductivity in an electrostatic spray coating system. More specifically, the subject invention relates to a rotary spray gun capable of improving the transfer efficiency of the coating by generating ionic lines to shape the spray pattern of the coating material being atomized by the spray gun.

Apparatus used for electrostatically coating objects such as, for example, an automobile body, have been in use for some time. Primarily, a voltage potential is applied to a spray head of a rotary atomizer in order to produce an electric field between the spray head and a grounded object to be coated. The charge generated by the spray head is transferred to the atomized coating material by direct contact as it is radially disbursed from the spray head.

An additional charge ring has been added to the spray apparatus primarily, for water borne coating materials. The charge ring typically includes a plurality of electrodes concentrically aligned with the axis of the spray head. The electrodes are generally coated with an insulating material, with a small pin protruding therefrom. A high voltage cable specifically supplies the electrical potential to the electrodes necessary for generating an electrical field for charging the particles sprayed from the spray head. Often, the electrodes will be charged to generate the electric field, and the spray head will be grounded. In this type of arrangement, the entirety of the electrostatic charge transferred to the coating material is generated from the electrodes concentrically aligned with the spray head.

While this type of electrostatic arrangement has proven quite effective for water borne based coating materials, it is not proven to be as effective for solvent borne coating materials. Therefore, the entirety of the electrostatic charge transferred to atomized particles in a solvent borne coating system is derived from the rotary spray head that has an electrical potential less than ground. Frequently, the mass of an atomized coating particle is too large when radially disbursed from the spray head will derive a physical potential greater than the electrical potential produced from the spray head. When this occurs, the atomized particle will be thrown laterally from the spray head and thus, will not be directed toward the grounded object to be painted. The frequency from which this happens is known to reduce the transfer efficiency of the atomized coating material onto the object to be painted.

Accordingly, it would be desirable to introduce an ionization ring to a solvent borne painting apparatus that can generate an ionic field capable of overcoming the momentum of the atomized coating particles that are disbursed laterally from the spray head.

SUMMARY OF THE INVENTION AND ADVANTAGES

The present invention comprises an apparatus for electrostatically coating objects with an electrically conductive coating material capable of carrying an ionic charge. A rotary atomizer utilizes a spray head that rotates on an axis at a high speed. An external housing is affixed to a support member that is oriented either horizontally or vertically depending upon the application needs of the object to be coated. The external housing pivotally supports the spray head and includes a non-conductive surface. Conductive elements such as a limb or structural band are disposed upon the housing. The conductive elements derive electrical potential that is generally the same as the electrical potential of the spray head. The non-conductive surface of the housing is at neutral potential relative to the potential of the spray head and the conductive elements.

An ionizing device is positioned on the housing to contact the conductive elements. Thus, the ionizing device derives an electrical potential that is generally the same as the spray head and the conductive elements. A halo with a plurality of generally conical members spaced therearound directs ionizing lines to shape the atomized coating material being radially disbursed from the spray head.

The generally conical members generate ionic lines at substantially the same potential as the spray head and the conductive elements. The ionic lines are disbursed at an electric potential strong enough to overcome the momentum of many of the electrostatically charged, atomized particles being radially disbursed from the spray head thereby forcing these atomized particles toward the grounded object to be painted. Therefore, the ionic lines generated from the generally conical members improve the transfer efficiency of the coating material dispersed from the spray head onto the object to be painted. Further, it should be understood by those of skill in the art that a reduction in the amount of shaping air necessary to shape the atomized particles can be achieved through the utilization of the improved ionic field generated by the inventive ionization ring. Through the reduction of shaping air, a reduction in dirt trapped in the paint coating can also be achieved due to the reduction in air turbulence in the paint booth.

BRIEF DESCRIPTION OF THE DRAWINGS

Other advantages of the present invention will be readily appreciated as the same becomes better understood by reference to the following detailed description when considered in connection with the accompanying drawings wherein:

FIG. 3 is a bottom view of the ionizing ring of the present invention;

FIG. 4 is a side view of the ionizing ring of the present invention;

FIG. 5 is a side sectional view of the generally conical member;

FIG. 6 is an exploded view of the rotary atomizer and the ionizing ring showing the shrouds positioned over the generally conical members;

FIG. 7 shows an alternative embodiment of the conductive members;

FIG. 8 is a perspective view of the shroud; and

FIG. 9 is a sectional view of a shroud positioned over a generally conical member.

DETAILED DESCRIPTION OF THE PREFERRED EMBODIMENT

Figure 1:
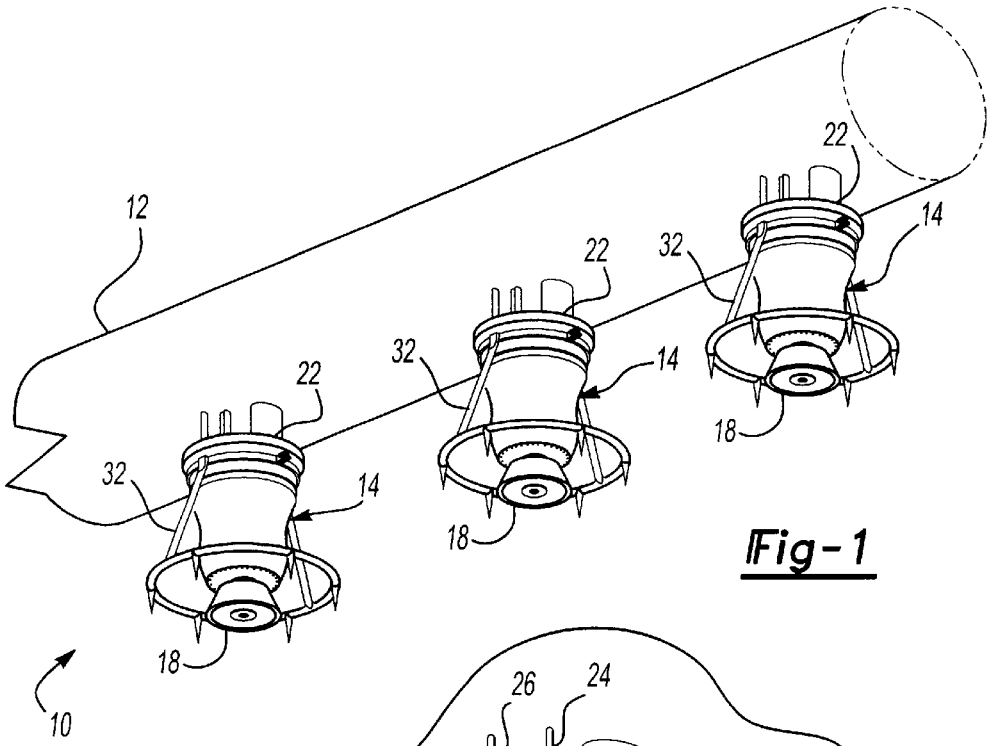
FIG. 1 shows three rotary atomizers affixed to a horizontal support member having the ionizing ring of the present invention affixed thereto.

Referring to FIG. 1, an apparatus for electrostatically coating objects with a coating material is generally shown at 10 affixed to a horizontally oriented support member 12.

Figure 2:
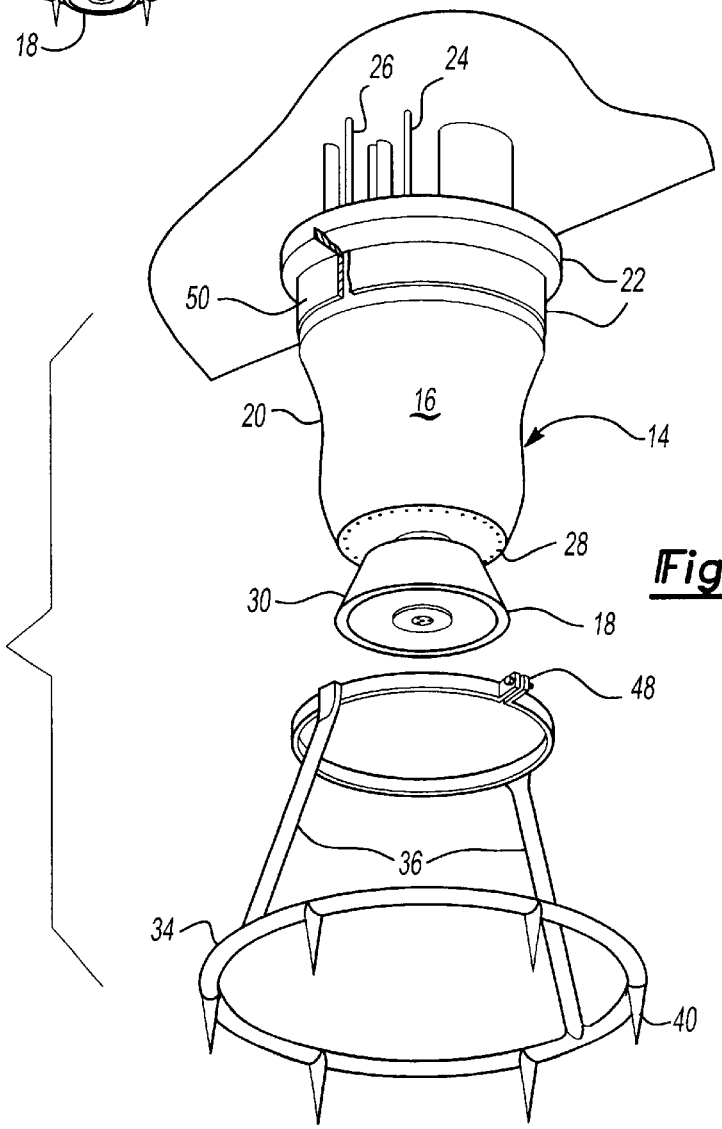
FIG. 2 is an exploded view of ionizing ring and the rotary atomizer.

FIG. 1 shows three of the apparatus 10 affixed to the support member 12, however, one, two, three or more of the apparatus 10 may be affixed to the support member 12 as needed to sufficiently coat an object (not shown) with the coating material. As best seen in FIG. 2, the apparatus includes a rotary atomizer 14 having a housing 16 and a spray head 18.

The housing 16 includes a non-conductive surface 20 and conductive elements 22. The conductive elements 22 derive electrical potential from the support member 12 and transfer that potential to the spray head 18. A paint line 24 feeds solvent borne coating material through the support member 12 to the spray head 18 in the direction of the target. An air line 26 feeds pressurized air through the support member 12 and through the housing 14 to shaping air apertures 28 disposed in the housing concentrically aligned with the axis of the spray head 18 to shape the coating material being disbursed from the spray head 18 in the direction of the target.

The spray head 18, as known in the art, atomizes the coating material by spinning at a high rate of speed and radially disbursing the atomized coating from an annular spray edge 30. The spray head 18 ionizes the atomized coating material at a potential that is lower than ground. Preferably, the potential is approximately −90 KV. However, the operating range is between −70 and −100 KV depending upon the coating operation being performed. The object to be painted is typically grounded and, therefore, the ionized particles are attracted to the object to be painted as is well known in the art. The support member 12, the conductive elements 22, and the spray head 18 each have an electrical potential that is generally at the same level.

Referring again to FIG. 1, an ionizing device 32 is affixed to the housing 16 of the apparatus 10. The ionizing device 32 is positioned upon the housing 16 to contact the conductive elements 22. The ionizing device 32 is formed from a conductive material such as, for example, steel or an equivalent, and therefore generally derives the same electrical potential as that of the conductive element 22.

As best shown in FIGS. 2 through 4, the ionizing device 32 includes a halo 34 spaced from, and concentrically aligned with the axis of the spray head 18. A pair of support arms 36 affix the halo to a band 38. A plurality of generally conical members 40 are affixed to the halo 34, the purpose of which will be explained further below.

The band includes a clamping element 42 used to tighten the band 38 around the housing 16 thereby affixing the ionizing device 32 to the apparatus 10. In the preferred embodiment, the clamping element includes opposing tabs 44 spaced by a gap 46 in the band 38. A fastener 48 (FIG. 2) is inserted through the tabs 44 to narrow the gap 46 in the band 38 and tighten the band 38 around the housing 16. The band 38 is positioned to contact the conductive elements 22 on the housing 16. The conductive elements 22 are shown in FIG. 2 as a conductive band 50 that circumscribes the housing 16. Alternatively, as shown in FIGS. 6 and 7, the conductive elements 22 comprise a conductive rim 52 having a plurality of protuberances 54 disposed thereon. In this embodiment, the band 38 contacts the protuberances 56 deriving the ionizing electrical potential in that manner.

Referring to FIG. 5, each of the generally conical members 40 includes a threaded shaft 58. The threaded shaft 58 is used to affix the generally conical member 40 to the halo 34. Preferably, the generally conical member 40 will be permanently affixed to the halo 34 with adhesive, welding, or the like preventing the generally conical member 40 from being removed from the halo 34. Therefore, it is not necessary that the generally conical member 40 include a threaded shaft as alternative methods of attachment may be used as will be appreciated by those of skill in the art.

Referring to FIGS. 8 and 9, a shroud 60 covers each of the generally conical members 40. Each of the generally conical members 40 includes a tip 62 that protrudes through the shroud 60. A shaping surface 64 is disposed upon each shroud 60 having the tip 62 of the generally conical member 40 centrally located therein. Each shroud 60 includes a pair of snapping arms 66 that secure the shroud 60 to the halo 34. The shroud 60 is preferably formed from a fluorinated hydrocarbon, such as Teflon® available from DuPont Co. and is generally non-conductive. However, other equivalent non-conductive materials may also be used to form the shroud 60.

The ionic lines that generate the ionic field around the atomized coating materials emanate from the tip 62 of the generally conical members. The shaping surface 64 on each shroud 60 helps shape the ionic lines into an ionic field capable of shaping the dispersion pattern of the coating material. Each tip 62 is preferably pointed. The pointed tips 62 have proven to improve the transfer efficiency from the spray head 18 to the object to be painted by generally 5%. However, some test data has shown the transfer efficiency has been approved by up to 11%. The pointed tips 62 have proven to be most effective for improving transfer efficiency. However, other shapes such as rounded tips and spherical tips have also proved effective. Generally, the shape of a tip 62 can be tuned to meet the transfer efficiency needs of the object being painted.

Preferably, for heads having diameters between 40 and 70 mm, each tip 62 is spaced behind the spray head 18 from ¾ to 1 ½ inches. More preferably, each tip 62 is spaced behind the spray head 18 a distance of 1 inch or slightly less. The shroud 60 is generally shaped as a bell and has a base diameter of approximately ⅝ inches at the halo 34. At the tip 62, the shroud 60 has a tip diameter of approximately 1 inch. The shroud 60 extends past the tip 62 a distance of approximately ¼ inch. The dimensions listed above are correlated to the diameter of the spray head and can be modified according the diameter of the spray head.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. An apparatus for electrostatically coating objects with a solvent bourne liquid electrically conductive coating material comprising:

a rotary atomizer including a rotating spray head radially dispersing the atomized solvent bourne liquid coating material;

an external housing affixed to a support member and rotatably supporting said spray head, said housing having an external non-conductive surface extending to adjacent said spray head and conductive elements spaced from said spray head on an external surface of said external housing with said external non-conductive surface being at ground potential relative to said spray head and said conductive elements electrically connected to said spray head such that said spray head is at the same electrical potential as said conductive elements; and an ionizing device positioned on said housing electrically contacting said conductive elements and having a conductive halo with a plurality of generally conical conductive members spaced therearound directing ionizing lines to shape the atomized solvent bourne liquid coating material being dispersed from said spray head.

2. An apparatus as set forth in claim 1 wherein said conductive elements include a conductive band circumscribing said housing and at least one conductive support arm connecting said conductive halo to said band.

3. An apparatus as set forth in claim 1 wherein generally conical conductive members include tips being pointed, each of said tips being positioned behind said atomized paint being dispersed from said spray head.

4. An apparatus as set forth in claim 3 wherein each of said generally conical conductive members includes a non-conductive shroud positioned thereupon with said tip projecting therethrough.

5. An apparatus as set forth in claim 4 wherein each of said shrouds includes a bell-shaped shaping surface having said tip centered therein whereby said shaping surface shapes said ionizing lines.

6. An apparatus as set forth in claim 5 wherein said shroud comprises a fluorinated hydrocarbon.

7. An apparatus as set forth in claim 6 wherein said shroud includes snapping arms having said halo clasped therebetween for affixing said shroud to said halo.

8. An apparatus as set forth in claim 1 wherein each of said generally conical members includes a shaft being threaded into an aperture disposed in said a halo thereby affixing said generally conical member to said halo.

9. The apparatus as set forth in claim 1, wherein said support member is electrically conductive at a negative electrical potential and electrically connected to said conductive elements, such that said spray head and said conductive members are at the same negative potential.

10. An apparatus for electrostatically coating objects with a solvent bourne liquid coating material, comprising:

a rotary atomizer including a rotating spray head radially disbursing the atomized solvent bourne liquid coating material;

an external housing affixed to a support member rotatably supporting said spray head, said housing having an external non-conductive surface extending to said spray head and a conductive element spaced from said spray head on an external surface of said external housing with said external non-conductive surface being at ground potential relative to said spray head and said conductive element electrically connected to said spray head such that said spray head is at a negative electrical potential imparting an electrical charge to said solvent bourne liquid coating material and said conductive element is at the same negative electrical potential; and an ionizing device supported on said housing including an electrically conductive arm electrically contacting said conductive element including a conductive halo surrounding said housing having a plurality of circumferentially spaced conductive elements each having a conical tip portion connected to said halo and non-conductive shrouds surrounding said conductive elements each having a bell-shaped internal surface surrounding said conical tip portion, whereby said conductive elements direct ionizing lines to shape the atomized solvent bourne liquid coating material disbursed from said spray head and said bell-shaped internal surface of said non-conductive shrouds direct said ionized lines axially toward a work surface opposite said spray head.

11. The apparatus as defined in claim 10, wherein said non-conductive shrouds are connected to said conductive halo.

12. The apparatus as defined in claim 11, wherein said non-conductive shrouds are releasably affixed to said conductive halo by opposed flexible arms.

13. The apparatus as defined in claim 10, wherein said tip portions of said conductive elements are spaced below an end portion of said bell-shaped internal surface of said non-conductive shrouds.

14. The apparatus as defined in claim 10, wherein said support member is electrically conductive at a negative electrical potential and electrically connected to said conductive element, such that said spray head and said conductive elements are at the same negative potential.

* * * * *